US007007674B2

(12) United States Patent
Streb et al.

(10) Patent No.: US 7,007,674 B2
(45) Date of Patent: Mar. 7, 2006

(54) FUEL RAIL ASSEMBLY

(75) Inventors: Michael T. Streb, Plymouth, MI (US); William M. Warner, Summerville, SC (US)

(73) Assignee: Robert Bosch Corporation, Broadview, IL (US)

( * ) Notice: Subject to any disclaimer, the term of this patent is extended or adjusted under 35 U.S.C. 154(b) by 45 days.

(21) Appl. No.: 10/404,226

(22) Filed: Apr. 1, 2003

(65) Prior Publication Data

US 2004/0194760 A1 Oct. 7, 2004

(51) Int. Cl.
*F02M 37/04* (2006.01)

(52) U.S. Cl. ..... 123/468; 123/456

(58) Field of Classification Search ..... 123/468, 123/469, 456, 470, 509
See application file for complete search history.

(56) References Cited

U.S. PATENT DOCUMENTS 4,092,517 A * 5/1978 Woodacre ..... 219/137 PS
4,552,311 A 11/1985 Casey
4,563,984 A 1/1986 Ziegler et al.
4,660,531 A * 4/1987 Lauterbach et al. ..... 123/456
4,966,120 A 10/1990 Itoh et al.
4,982,716 A 1/1991 Takeda et al.
5,086,743 A 2/1992 Hickey
5,120,084 A 6/1992 Hashimoto
5,127,382 A 7/1992 Imoehl
5,168,857 A * 12/1992 Hickey ..... 123/468
5,172,671 A 12/1992 Peters et al.
5,172,939 A 12/1992 Hashimoto
5,189,782 A 3/1993 Hickey
5,197,435 A 3/1993 Mazur et al.
5,215,063 A 6/1993 Yeh
5,220,900 A 6/1993 Wakeman
5,295,468 A 3/1994 Blessing et al.
5,363,825 A 11/1994 Becker
5,390,638 A 2/1995 Hornby et al.
5,398,656 A 3/1995 Brisbane et al.
5,531,202 A 7/1996 Lorraine
5,568,798 A 10/1996 Lorraine
5,577,480 A 11/1996 Gmelin et al.
5,597,980 A 1/1997 Weber
5,598,824 A 2/1997 Treusch et al.
5,603,302 A * 2/1997 Minagawa et al. ..... 123/456
5,611,313 A 3/1997 Ashcraft
5,616,037 A * 4/1997 Lorraine et al. ..... 439/130
5,617,827 A * 4/1997 Eshleman et al. ..... 123/456
5,657,733 A 8/1997 Dozier et al.
5,713,323 A 2/1998 Walsh et al.
5,718,206 A * 2/1998 Sawada et al. ..... 123/470
5,735,247 A 4/1998 Tsuzuki et al.
5,743,235 A 4/1998 Lueder
5,771,863 A 6/1998 Daly
5,775,302 A * 7/1998 Guido et al. ..... 123/468

(Continued)

FOREIGN PATENT DOCUMENTS

DE 197 57 347 6/1998

*Primary Examiner*—Carl S. Miller
(74) *Attorney, Agent, or Firm*—Michael Best & Friedrich LLP

(57) ABSTRACT

A fuel rail assembly configured for coupling to an engine, the fuel rail including a body having therein a fuel passageway, and a fuel injector coupled to the body and in fluid communication with the fuel passageway. A portion of the body is configured to interconnect with the engine assembly to secure the fuel rail assembly to the engine without using conventional threaded fasteners.

43 Claims, 3 Drawing Sheets

U.S. PATENT DOCUMENTS

| | | | | |
|---|---|---|---|---|
| 5,934,252 | A | 8/1999 | Hafner et al. | |
| 5,934,253 | A | 8/1999 | Kojima et al. | |
| 6,053,149 | A | 4/2000 | Lorraine | |
| 6,186,122 | B1 | 2/2001 | Leung | |
| 6,196,195 | B1 | 3/2001 | Trutschel et al. | |
| 6,227,170 | B1 * | 5/2001 | Koshiba | 123/456 |
| 6,341,595 | B1 * | 1/2002 | Scollard et al. | 123/456 |
| 6,575,141 | B1 * | 6/2003 | Murphy | 123/468 |
| 6,622,700 | B1 * | 9/2003 | Lee et al. | 123/456 |
| 6,651,628 | B1 * | 11/2003 | Nally | 123/470 |
| 2003/0070658 | A1 * | 4/2003 | Warner et al. | 123/456 |

* cited by examiner

FUEL RAIL ASSEMBLY

FIELD OF THE INVENTION

The invention relates to fuel rail assemblies for the fuel system of an internal combustion engine.

BACKGROUND OF THE INVENTION

Generally, a fuel rail supplies fuel to multiple fuel injectors that inject fuel into the intake manifold of an engine. Conventionally, the inlet ends of the fuel injectors are removably secured to the fuel rail using clips or other similar mechanical attachment means. The outlet ends of the fuel injectors typically engage corresponding openings or ports in the intake manifold. The conventional fuel rail typically includes at least one flange shaped to engage with the intake manifold once the fuel injectors are positioned in the respective manifold ports, such that a conventional fastener (e.g., a bolt or sheet metal screw) may secure the flange to the intake manifold, thereby securing the fuel rail and the fuel injectors to the intake manifold.

SUMMARY OF THE INVENTION

The present invention provides an improved fuel rail assembly that does not require the use of conventional threaded fasteners to secure the fuel rail and fuel injectors to the intake manifold. By eliminating the use of conventional threaded fasteners, the number of parts and the cost and time for assembly are reduced.

The fuel rail assembly of the present invention generally provides an improved connection configuration with the intake manifold. The improved connection configuration is facilitated, in part, by the construction of the fuel rail assembly, which is similar to the fuel rail assembly disclosed in U.S. patent application Ser. No. 09/981,223 filed on Oct. 17, 2001 and assigned to the Robert Bosch Corporation, the entire contents of which is incorporated herein by reference.

More specifically, the present invention provides a fuel rail assembly configured for coupling to an engine, the fuel rail assembly including a body having therein a fuel passageway, and a fuel injector coupled to the body and in fluid communication with the fuel passageway. A portion of the body is configured to interconnect with the engine assembly to secure the fuel rail assembly to the engine without using conventional threaded fasteners.

The present invention also provides an engine assembly including a fuel rail assembly having a body including therein a fuel passageway, and a fuel injector coupled to the body and in fluid communication with the fuel passageway. The engine assembly also includes an engine having an opening to receive the fuel injector therein. At least a portion of the body is interconnected with the engine such that the body is secured to the engine without using conventional threaded fasteners.

Further, the present invention provides a method of installing a fuel rail assembly onto an intake manifold of an internal combustion engine, the intake manifold having a receiving portion. The method includes providing a fuel rail assembly including a body having therein a fuel passageway, and at least one fuel injector coupled to the body and in fluid communication with the fuel passageway, a portion of the body defining a fastening member. The method also includes aligning the fastening member with the receiving portion of the intake manifold, and interconnecting the fastening member with the receiving portion to secure the fuel rail assembly to the intake manifold without conventional threaded fasteners.

Other features and aspects of the invention will become apparent to those skilled in the art upon review of the following detailed description, claims, and drawings.

Figures 1, 2, 3:
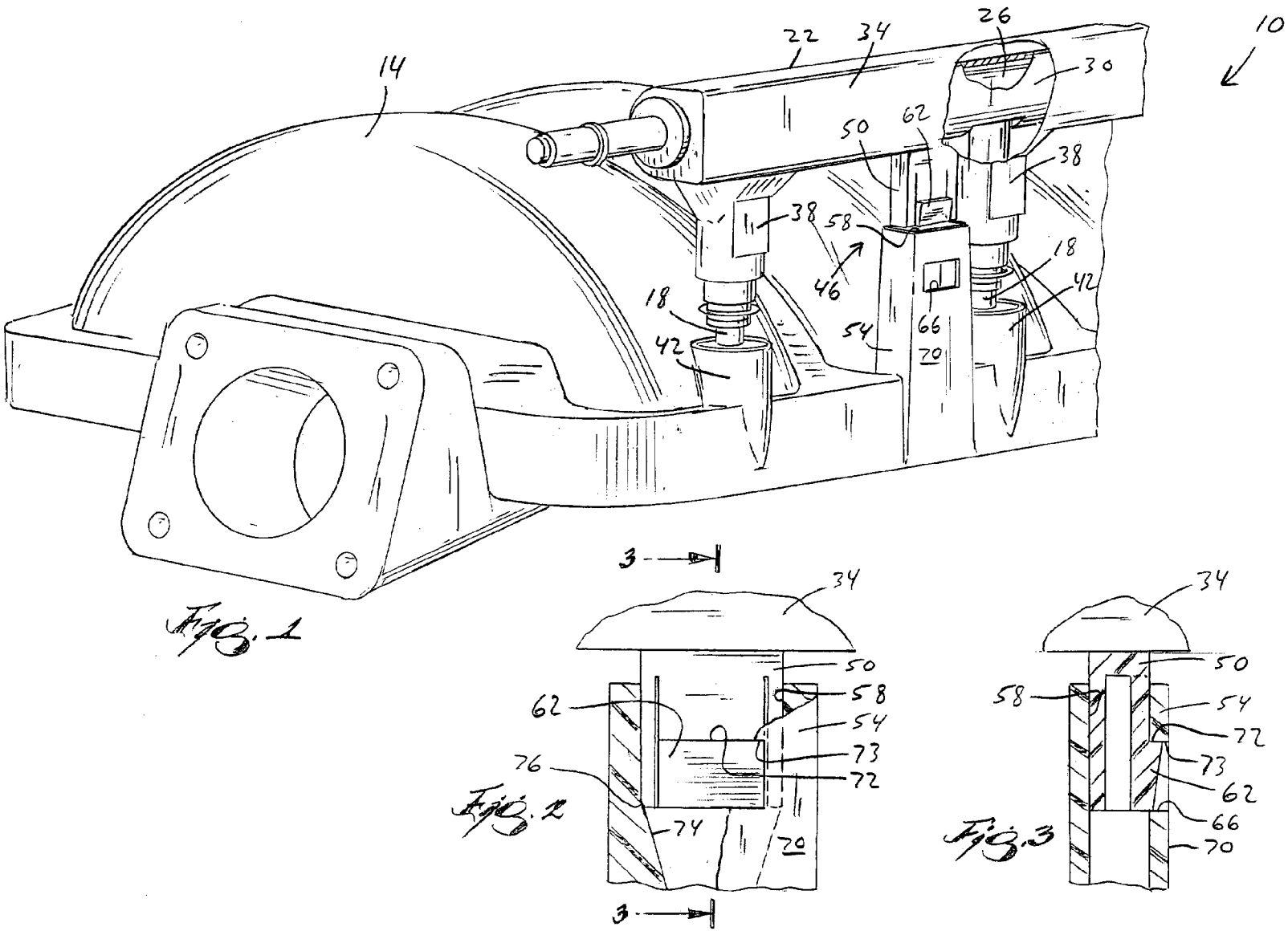
FIG. 1 is a partial perspective view of one construction of a fuel rail assembly embodying the present invention, illustrating one construction of a connector assembly connecting the fuel rail assembly with a portion of an engine.
FIG. 2 is a frontal partial cutaway view of the connector assembly.
FIG. 3 is a section view of the connector assembly taken along line 3—3 of FIG. 2.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION

With reference to FIG. 1, one construction of a fuel rail assembly 10 embodying the present invention is shown. The fuel rail assembly 10 is shown in relation to a portion of an engine defining an intake manifold 14. For purposes of clarity, only a portion of the fuel rail assembly 10 and the intake manifold 14 is shown. Also, it should be known that the fuel rail assembly 10 is not limited for use in any particular engine configuration, and can be used with engine configurations other than the configuration partially illustrated in FIG. 1.

FIG. 1 illustrates an intake manifold 14 used in a V-8 engine configuration, including two banks, each bank including four fuel injectors 18 feeding four respective cylinders (not shown). Also, for purposes of clarity, only one bank of fuel injectors 18 is partially shown in FIG. 1. In one construction of the present invention, the body 22 includes a fuel rail 30 having therein a fuel passageway 26, and an overmolding 34 that substantially covers or encloses the fuel rail 30. In this construction, the fuel injectors 18 are coupled to the fuel rail 30, such that the fuel injectors 18 are fluidly connected with the fuel passageway 26. In such a construction, the fuel rail 30 is preferably made of metal, while the overmolding 34 is preferably formed from plastic to enclose the fuel rail 30 in a conventional overmolding process. Alternatively, the fuel rail 30 may also be formed from plastic. Also, a portion of the overmolding 34, or fuel injector overmold 38, covers or encloses a portion of each fuel injector 18, such that the interface between the fuel rail 30 and each fuel injector 18 is covered by the fuel injector overmold 38. Therefore, any fuel potentially leaking between the fuel rail 30 and the fuel injector 18 is prevented from escaping the fuel rail assembly 10. As a result, undesirable evaporative emissions from the fuel rail assembly 10 are decreased.

Alternatively, in another construction of the fuel rail assembly 10, the fuel rail assembly 10 may include a body 22 defining a fuel passageway 26 therein. The fuel injectors 18 may couple to the body 22 and fluidly communicate with the fuel passageway 26, such that fuel from a fuel source (not shown) is delivered to the fuel injectors 18 via the fuel passageway 26. In such a construction, the body 22 may be formed as a singular piece of molded plastic and include portions which cover or enclose a portion of each fuel injector 18.

As shown in FIG. 1, the fuel injectors 18 are inserted into engine openings in the form of fuel injector cups 42 defined in the intake manifold 14. While positioned in the fuel injector cups 42, each fuel injector 18 is aligned with an intake runner (in the cylinder head portion of the engine, not shown) to supply a mixture of air and fuel to an associated cylinder. In the construction illustrated in FIG. 1, a connector assembly 46 is shown to releasably secure the body 22, and therefore the fuel rail assembly 10, to the intake manifold 14. The fuel injectors 18 are maintained within their respective fuel injector cups 42 by the connector assembly 46. The connector assembly 46 includes a first part in the form of a fuel rail post 50 extending away from the body 22 and toward the intake manifold 14. In the illustrated construction of FIG. 1, the fuel rail post 50 is integrally formed with the overmolding 34. However, the fuel rail post 50 may also be a separate component coupled to the overmolding 34 in another construction of the fuel rail assembly 10.

The connector assembly 46 also includes a second part in the form of an intake manifold post 54 extending away from the intake manifold 14 and toward the body 22. In the illustrated construction of FIG. 1, the intake manifold post 54 is integrally formed with the intake manifold 14. However, the intake manifold post 54 may also be a separate component coupled to the intake manifold 14 in another construction of the fuel rail assembly 10.

The intake manifold post 54 includes an opening 58 to receive the fuel rail post 50 therein. Although the connector assembly 46 is shown spaced from the fuel injectors 18 and positioned between adjacent fuel injectors 18 in FIG. 1, many different configurations and placements of the connector assemblies 46 are possible and fall within the spirit and scope of the present invention. For example, one or more connector assemblies 46 may be used per bank of fuel injectors 18 to secure the fuel rail assembly 10 to the intake manifold 14. In the illustrated construction of FIG. 1, in which four fuel injectors 18 comprise each bank of fuel injectors 18, connector assemblies 46 may be utilized, among other locations, between the first and second fuel injectors 18 and the third and fourth fuel injectors 18, between the first and second, second and third, and third and fourth fuel injectors 18, or solely between the second and third fuel injectors 18.

The connector assembly 46 also includes a locking mechanism in the form of a snap-fit mechanism, more specifically a resilient tab 62, which is integrally formed with the fuel rail post 50. Upon assembling the fuel rail assembly 10 and the intake manifold 14, the fuel rail post 50 is inserted into the opening 58 of the intake manifold post 54, thereby causing the resilient tab 62 to initially deflect as it enters the opening 58. An aperture 66 is formed in a side wall 70 of the intake manifold post 54 to allow the resilient tab 62 to "snap back" to its undeflected shape into the aperture 66, thus interlocking the fuel rail post 50 and the intake manifold post 54. The resilient tab 62 includes a shoulder 72 which abuts an upper edge 73 of the aperture 66 to substantially prevent withdrawal of the fuel rail post 50 from the intake manifold post 54. The resilient tab 62 and the aperture 66 may be formed on any side of their respective posts 50, 54 such that the resilient tab 62 and aperture 66 are aligned upon assembly of the fuel rail assembly 10 and the intake manifold 14. To unlock and disassemble the fuel rail assembly 10 from the intake manifold 14, the resilient tab 62 is pushed back to its deflected shape so the shoulder 72 disengages the upper edge 73 of the aperture 66. This permits the fuel rail post 50 to be disengaged and withdrawn from the intake manifold post 54.

As shown in FIG. 2, the intake manifold post 54 includes a tapered interior surface 74. Upon insertion into the intake manifold post 54, a distal end 76 of the fuel rail post 50 frictionally engages the tapered interior surface 74 before the resilient tab 62 snaps into the aperture 66, during which time the distal end 76 of the fuel rail post 50 and the portion of the tapered interior surface 74 in frictional engagement with the distal end 76 elastically deform. After the distal end 76 of the fuel rail post 50 and the portion of the tapered interior surface 74 elastically deform to an extent allowing the fuel rail post 50 to be inserted sufficiently far enough into the intake manifold post 54, the resilient tab 62 snaps into the aperture 66, therefore interlocking the fuel rail post 50 and the intake manifold post 54. After the resilient tab 62 snaps into the aperture 66, the previously-elastically deformed distal end 76 and frictionally engaged portion of the tapered interior surface 74 are allowed to recover to their undeformed or substantially undeformed shapes, thereby tending to bias the fuel rail post 50 out of the intake manifold post 54 (upward in FIG. 2). In other words, the tapered interior surface 74 of the intake manifold post 54 tends to urge the fuel rail post 50 toward disengagement with the intake manifold post 54 when the distal end 76 of the fuel rail post 50 frictionally engages the tapered interior surface 74 of the intake manifold post 54. As a result, the shoulder 72 of the resilient tab 62 is maintained in tight abutment (see FIG. 3) with the upper edge 73 of the aperture 66, thereby substantially preventing unwanted or accidental unlocking of the posts 50, 54.

In another configuration of the connector assembly (not shown), the configurations of the fuel rail and intake manifold posts may be reversed, such that the fuel rail post includes the opening to receive therein the intake manifold post, and the intake manifold post includes the resilient tab, which engages an aperture in the fuel rail post to interlock the posts. Also, in yet another configuration of the connector assembly (not shown), a singular post extending from one of the body and the intake manifold may be inserted into a corresponding opening not otherwise defined in a post-like member formed in the other of the body and the intake manifold. Further, the resilient tab may be formed with the post, and the aperture (or a recess) may be formed in the opening to accept the resilient tab. Those skilled in the art will also recognize that the illustrated tab-and-aperture locking mechanism is only one type of suitable locking mechanism, and that other types could be substituted. Such other types of locking mechanisms may include, among others, spring-loaded detent mechanisms, latch mechanisms, and snap-fit mechanisms.

Figure 5:
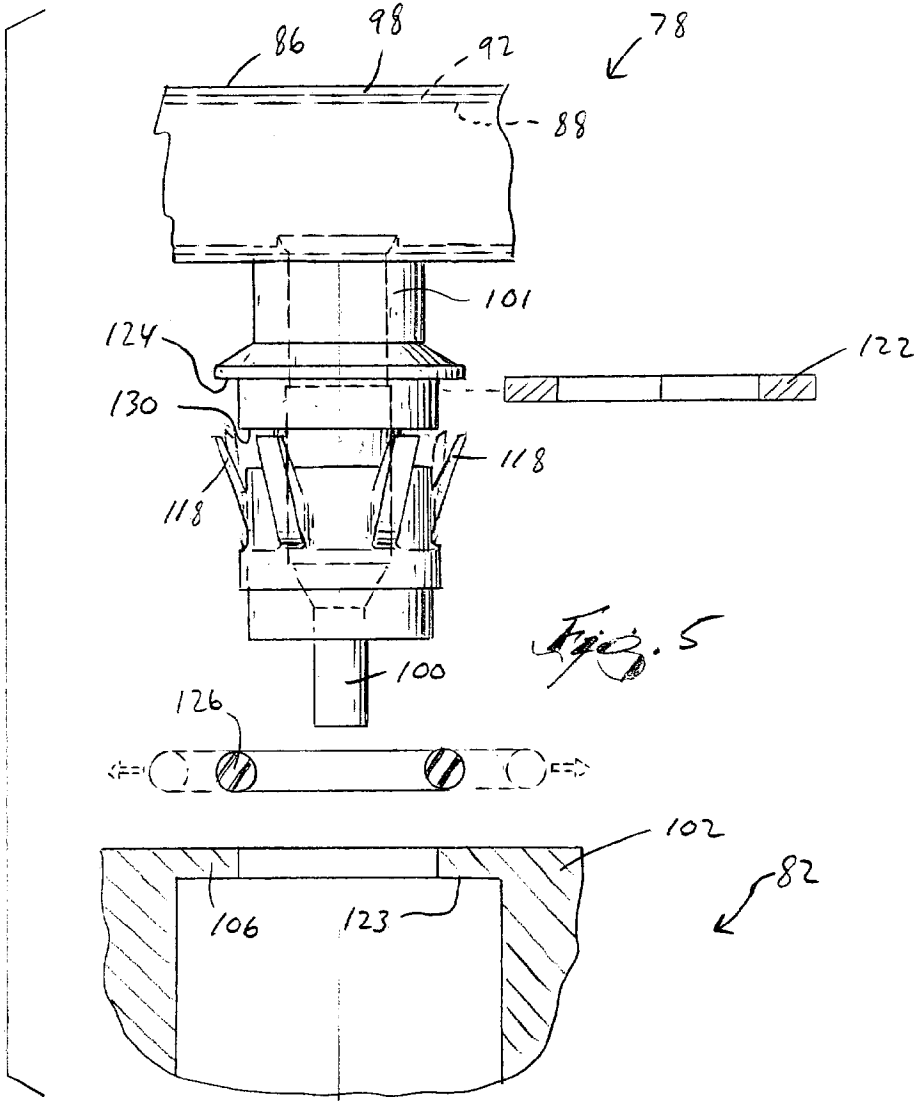
FIG. 5 is a frontal exploded view of the connector assembly of FIG. 4.
Figure 4:
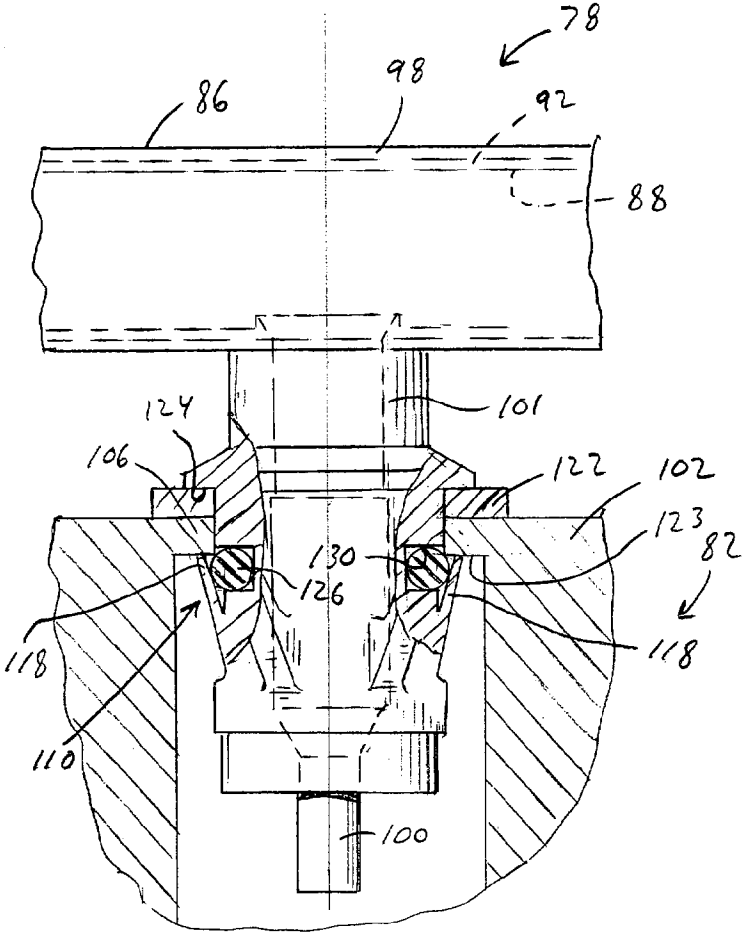
FIG. 4 is a frontal partial cutaway view of another construction of the fuel rail assembly embodying the present invention, illustrating another construction of the connector assembly connecting the fuel rail assembly with a portion of the engine.

FIGS. 4–5 illustrate another construction of a fuel rail assembly 78 embodying the present invention. Like the fuel rail assembly 10, the fuel rail assembly 78 is shown in relation to a portion of an engine defining an intake manifold 82. Also, like the fuel rail assembly 10, only a portion of the fuel rail assembly 78 is shown for purposes of clarity. In one construction of the present invention, the fuel rail assembly includes a body 86 having a fuel rail 92 therein. The fuel rail 92 includes therein the fuel passageway 88, and an overmolding 98 substantially covers or encloses the fuel rail 92. In this construction, fuel injectors 100 are coupled to the fuel rail 92, such that the fuel injectors 100 are fluidly connected with the fuel passageway 88. In such a construction, the fuel rail 92 is preferably made of metal, while the overmolding 98 is preferably formed from plastic to enclose the fuel rail 92 in a conventional overmolding process. Alternatively, the fuel rail 92 may also be formed from plastic. Also, a portion of the overmolding 98, or fuel injector overmold 101, covers or encloses a portion of each fuel injector 100, such that the interface between the fuel rail 92 and each fuel injector 100 is covered by the fuel injector overmold 101.

Alternatively, in another construction, the fuel rail assembly 78 includes a body 86 defining a fuel passageway 88 therein. Fuel injectors 100 are coupled to the body 86 and fluidly communicate with the fuel passageway 88, such that fuel from a fuel source (not shown) is delivered to the fuel injectors 100 via the fuel passageway 88. In such a construction, the body 86 is preferably formed as a singular piece of molded plastic and include portions which cover or enclose a portion of each fuel injector 100.

The fuel injectors 100 are inserted into engine openings in the form of fuel injector cups 102 defined in the intake manifold 82. The fuel injector cups 102 are shaped having a stepped opening, such that lips 106 are formed in the upper ends of the cups 102 (as shown in FIGS. 4–5). As shown in FIG. 4, a connector assembly 110 is utilized to secure the fuel rail assembly 78 to the intake manifold 82. A first part of the connector assembly 110 is defined by the configuration of the fuel injector overmold 101. The connector assembly 110 also includes a second part defined by the fuel injector cups 102, each of which includes a lip 106, such that each fuel injector overmold 101 is inserted into a respective fuel injector cup 102.

Although only a singular connector assembly 110 is shown in FIGS. 4–5 in conjunction with a singular fuel injector 100, many different configurations and placements of the connector assembly 110 are possible and fall within the spirit and scope of the present invention. For example, connector assemblies 110 may be only utilized on one, some, or all the fuel injectors 101 in a particular bank of fuel injectors 101 to secure the fuel rail assembly 78 to the intake manifold 82.

The connector assembly 110 also includes a locking mechanism in the form of a snap-fit mechanism, more specifically multiple resilient tabs 118, which are integrally formed with the fuel injector overmold 101. Upon assembling the fuel rail assembly 78 and the intake manifold 82, each fuel injector overmold 101 is inserted into its associated fuel injector cup 102, thereby causing the resilient tabs 118 to initially deflect as they contact the lip 106. As the resilient tabs 118 pass by the lip 106, the resilient tabs 118 "snap back" to their undeflected shapes, thus interlocking the fuel injector overmold 101 and the fuel injector cup 102. As shown in FIGS. 4–5, a retainer clip 122 is engaged with a shoulder 124 formed in the fuel injector overmold 101 to act as a spacer, thus maintaining the resilient tabs 118 in abutment with an inside shoulder 123 of the lip 106 to substantially prevent unwanted or accidental movement of the fuel injector 100 in the injector cup 102.

A seal 126 in the form of an o-ring is provided around the fuel injector overmold 101 in a groove 130 formed in the fuel injector overmold 101. The seal 126 substantially prevents leakage through a gap between the fuel injector overmold 101 and the lip 106. The seal 126 is supported in the groove 130 by the resilient tabs 118 in such a fashion to pre-load the seal 126. By doing this, the seal 126 is substantially prevented from moving around or displacing during insertion of the fuel injector overmold 101 into the fuel injector cup 102. During assembly of the fuel rail assembly 78, the seal 126 may be stretched over the resilient tabs 118 before finally being positioned in the groove 130.

Figure 7:
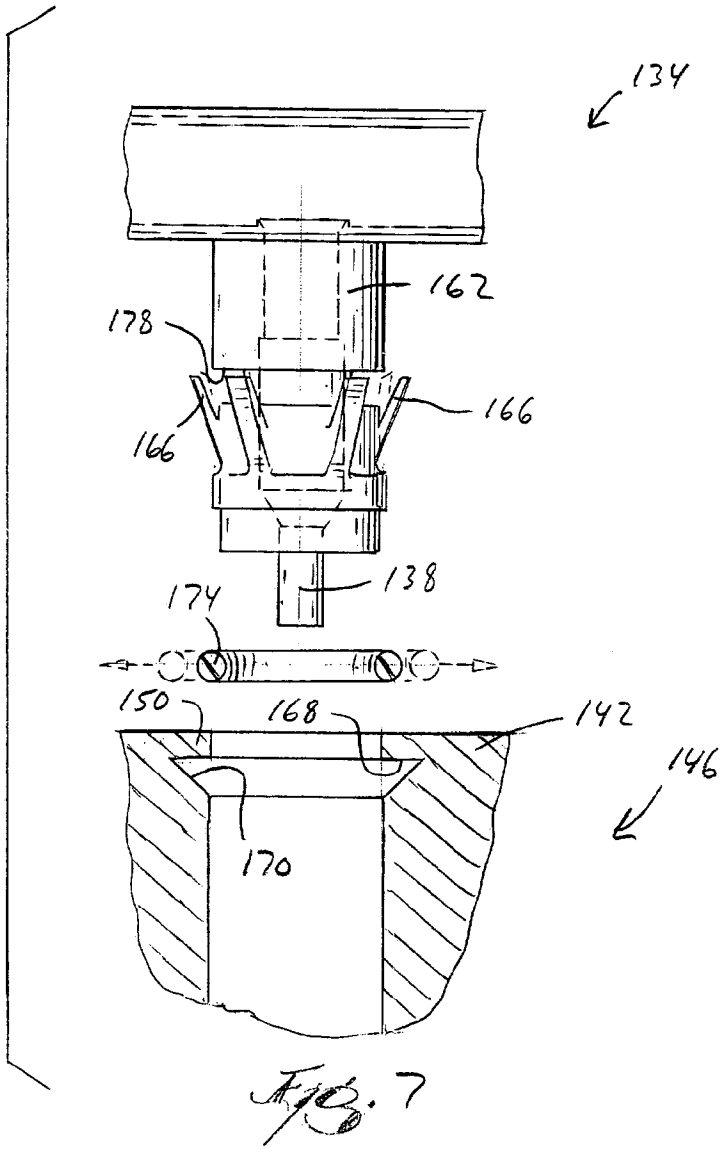
FIG. 7 is a frontal exploded view of the connector assembly of FIG. 6.
Figure 6:
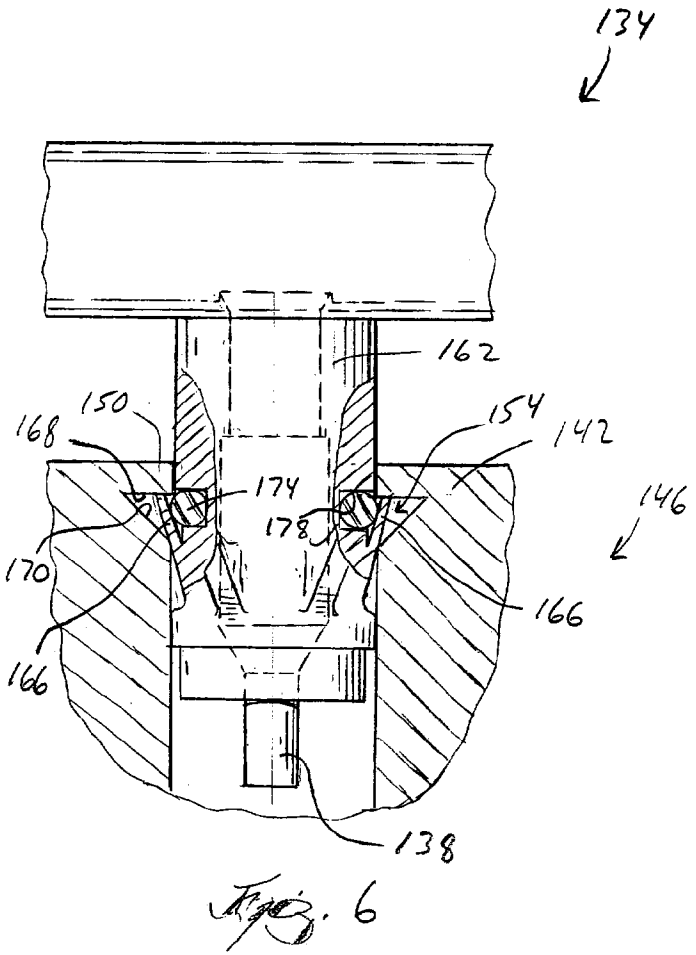
FIG. 6 is a frontal partial cutaway view of yet another construction of the fuel rail assembly embodying the present invention, illustrating yet another construction of the connector assembly connecting the fuel rail assembly with a portion of the engine.

FIGS. 6–7 illustrate yet another construction of a fuel rail assembly 134 embodying the present invention. The fuel rail assembly 134 is substantially the same as the fuel rail assembly 78 of FIGS. 4–5, with the exception that a shoulder (124 in FIGS. 4–5) is not used in combination with a retainer clip (122 in FIGS. 4–5) to support the fuel rail assembly in the engine.

Fuel injectors 138 are inserted into engine openings in the form of fuel injector cups 142 defined in an intake manifold 146. The fuel injector cups 142 are shaped having a stepped opening, such that a lip 150 is formed in the upper end of each cup 142 (as shown in FIGS. 6–7). As shown in FIG. 6, a connector assembly 154 is utilized to secure the fuel rail assembly 134 to the intake manifold 146. A first part of the connector assembly 154 is defined by the configuration of a fuel injector overmold 162 at least partially covering or enclosing each fuel injector 138. The connector assembly 110 also includes a second part defined by the fuel injector cups 142, each of which includes a lip 150, such that each fuel injector overmold 162 is inserted into a respective fuel injector cup 142.

The connector assembly 154 also includes a locking mechanism in the form of a snap-fit mechanism, more specifically multiple resilient tabs 166, which are integrally formed with each fuel injector overmold 162. Upon assembling the fuel rail assembly 134 and the intake manifold 146, each fuel injector overmold 162 is inserted into its associated fuel injector cup 142, thereby causing the resilient tabs 166 to initially deflect as they contact the lip 150. As the resilient tabs 166 pass by an inside shoulder 168, the resilient tabs 166 "snap back" to their undeflected shapes, thus interlocking the fuel injector overmold 162 and the fuel injector cup 142.

The injector cup 142 includes a tapered interior surface 170, such that lower portions of the resilient tabs 166 frictionally engage the tapered interior surface 170 in much the same way as the fuel rail post 50 engages the tapered interior surface 74 of the intake manifold post 54. Upon insertion into the injector cup 142, the lower portions (in FIG. 6) of the resilient tabs 166 frictionally engage the tapered interior surface 170 before the upper portions of the resilient tabs 166 snap back to their undeflected shapes after passing by the inside shoulder 168 of the lip 150, during which time the lower portions of the tabs 166 frictionally engaging the tapered interior surface 170 elastically deform. After passing by the inside shoulder 168, the upper portions of the resilient tabs 166 recover to their undeflected shapes, therefore interlocking the fuel injector overmold 162 and the injector cup 142. Upon completing the insertion of the fuel injector overmold 162 into the injector cup 142, the elastically deformed lower portions of the tabs 166 are allowed to recover to their undeformed or substantially undeformed shapes thereby tending to bias the fuel injector overmold 101 out of the fuel injector cup 142 (upward in FIG. 6). In other words, the tapered interior surface 170 of the injector cup 142 tends to urge the fuel injector overmold 101 toward disengagement with the fuel injector cup 142 when the lower portions of the resilient tabs 166 frictionally engage the tapered interior surface 170 of the fuel injector cup 142. As a result, the resilient tabs 166 are maintained in tight abutment (see FIG. 6) with the inside shoulder 168 of the lip 150, thereby substantially preventing unwanted or accidental movement of the fuel injector 138 in the injector cup 142.

Like the fuel rail assembly 78, the fuel rail assembly 134 includes a seal 174 in the form of an o-ring around the fuel injector overmold 162 in a groove 178 formed in the fuel injector overmold 162. The seal 174 substantially prevents leakage through a gap between the fuel injector overmold 162 and the lip 150. The seal 174 is supported in the groove 178 by the resilient tabs 166 in such a fashion to pre-load the seal 174. By doing this, the seal 174 is substantially prevented from moving around or displacing during insertion of the fuel injector overmold 162 into the fuel injector cup 142. During assembly of the fuel rail assembly 134, the seal 174 may be stretched over the resilient tabs 166 before finally being positioned in the groove 178.

Although only a singular connector assembly 154 is shown in conjunction with a singular fuel injector 138, many different configurations and placements of the connector assembly 154 are possible and fall within the spirit and scope of the present invention. For example, connector assemblies 154 may be utilized on one, some, or all the fuel injectors 138 in a particular bank of fuel injectors 138 to secure the fuel rail assembly 134 to the intake manifold 146.

We claim:

1. A fuel rail assembly configured for coupling to an engine, the fuel rail assembly comprising:

a body having therein a fuel passageway; and a fuel injector coupled to the body and in fluid communication with the fuel passageway;

wherein a portion of the body is configured to interconnect with the engine to secure the fuel rail assembly to the engine without the use of any additional fasteners, the portion of the body including at least part of a locking mechanism for locking the fuel rail assembly to the engine.

2. A fuel rail assembly configured for coupling to an engine, the fuel rail assembly comprising:

a body having therein a fuel passageway; and a fuel injector coupled to the body and in fluid communication with the fuel passageway;

wherein a portion of the body is configured to interconnect with the engine to secure the fuel rail assembly to the engine without the use of any additional fasteners; and wherein the body includes a fuel rail having therein the fuel passageway;

an overmolding at least partially covering at least one of the fuel rail and the fuel injector; and a connector coupled to the overmolding and configured to interconnect with the engine.

3. The fuel rail assembly of claim 2, wherein the connector is integrally formed with the overmolding.

4. The fuel rail assembly of claim 1, wherein the body includes a connector configured to interconnect with the engine, and wherein the at least part of the locking mechanism is on the connector.

5. The fuel rail assembly of claim 4, wherein a portion of the body at least partially covers the fuel injector, and wherein the connector is on the portion of the body at least partially covering the fuel injector.

6. The fuel rail assembly of claim 4, wherein the connector is on a portion of the body spaced from the fuel injector.

7. The fuel rail assembly of claim 4, wherein the at least part of the locking mechanism includes at least one resilient tab for locking the connector and the engine into engagement.

8. An engine assembly comprising:

a fuel rail assembly including a body having therein a fuel passageway, and a fuel injector coupled to the body and in fluid communication with the fuel passageway; and an engine including an engine opening to receive the fuel injector therein, wherein at least a portion of the body is interconnected with the engine such that the body is secured to the engine without using conventional threaded fasteners;

wherein the body is secured to the engine by a connector assembly, wherein the body includes a first part of the connector assembly and the engine includes a second part of the connector assembly, and wherein the first and second parts of the connector assembly are interengaged to secure the body to the engine; and wherein the first part of the connector assembly includes at least part of a locking mechanism for locking the first and second parts into engagement.

9. The engine assembly of claim 8, wherein the body includes a fuel rail including therein the fuel passageway; and an overmolding at least partially covering at least one of the fuel rail and the fuel injector, the first part of the connector assembly coupled to the overmolding.

10. The engine assembly of claim 9, wherein the first part of the connector assembly is integrally formed with the overmolding.

11. The engine assembly of claim 8, wherein a portion of the body at least partially covers the fuel injector, and wherein the first part of the connector assembly is defined by the portion of the body at least partially covering the fuel injector, and the second part of the connector assembly is defined by the engine opening.

12. The engine assembly of claim 11, wherein the locking mechanism is a resilient tab integrally formed with the portion of the body covering the fuel injector, wherein the engine opening includes a lip there around, and wherein the resilient tab deforms upon insertion into the engine opening, the tab rebounding after passing the lip and abutting the lip upon attempted removal of the fuel injector from the engine opening.

13. The engine assembly of claim 11, further including a seal around the portion of the body covering the fuel injector.

14. The engine assembly of claim 8, wherein the first part of the connector assembly is coupled to the body at a location spaced a distance from the fuel injector.

15. The engine assembly of claim 8, wherein the one of the first and second parts of the connector assembly is a post, and wherein the other of the first and second parts of the connector assembly includes a connector opening to snugly receive the post therein.

16. The engine assembly of claim 15, wherein the locking mechanism is a resilient tab integrally formed with the post, the resilient tab deforming upon insertion into the connector opening and rebounding after encountering an aperture adjacent the connector opening to lock the first and second parts into engagement.

17. An engine assembly comprising:

a fuel rail assembly having a body having therein a fuel passageway; and a fuel injector coupled to the body and in fluid communication with the fuel passageway;

wherein a portion of the body includes a first part of a connector assembly having a locking mechanism; and an engine including an engine opening to receive the fuel injector therein, the engine including a second part of the connector assembly, wherein the first part of the connector assembly is interengageable with the second part of the connector assembly to secure the body to the engine, and wherein the locking mechanism interlocks the first and second parts into engagement.

18. The engine assembly of claim 17, wherein the body includes a fuel rail including therein the fuel passageway; and an overmolding at least partially covering at least one of the fuel rail and the fuel injector;

wherein the first part of the connector assembly is coupled to the overmolding.

19. The engine assembly of claim 18, wherein the first part of the connector assembly is integrally formed with the overmolding, and wherein the second part of the connector assembly is integrally formed with the engine.

20. The engine assembly of claim 17, wherein a portion of the body at least partially covers the fuel injector, wherein the first part of the connector assembly and the locking mechanism is defined by the portion of the body at least partially covering the fuel injector, and wherein the second part of the connector assembly is defined by the engine opening.

21. The engine assembly of claim 20, wherein the engine opening includes a lip there around, and wherein the locking mechanism deflects upon insertion into the engine opening, the locking mechanism rebounding after passing the lip and abutting the lip upon attempted removal of the fuel injector from the engine opening.

22. The engine assembly of claim 21, further comprising a retainer clip engageable with the portion of the body covering the fuel injector, the retainer clip being configured to maintain the locking mechanism and the lip in abutment.

23. The engine assembly of claim 21, further comprising a seal around the portion of the body covering the fuel injector, the seal being at least partially pre-loaded by the locking mechanism.

24. The engine assembly of claim 17, wherein the first part of the connector assembly is coupled to the body at a location spaced a distance from the fuel injector.

25. The engine assembly of claim 17, wherein one of the first and second parts of the connector assembly is a post, and wherein the other of the first and second parts of the connector assembly includes a connector opening to snugly receive the post therein.

26. The engine assembly of claim 25, wherein the locking mechanism deflects upon insertion into the connector opening and rebounds after encountering an aperture adjacent the connector opening to interlock the first and second parts of the connector assembly into engagement.

27. The engine assembly of claim 25, wherein the first part of the connector assembly is a first post extending from the body, wherein the second part of the connector assembly is a second post extending from the engine, and wherein the second post includes the connector opening to snugly receive the first post therein.

28. The engine assembly of claim 27, wherein the second post includes a tapered interior surface, and wherein the first post at least partially frictionally engages at least part of the tapered interior surface before the locking mechanism interlocks the first and second posts into engagement.

29. The engine assembly of claim 17, wherein the locking mechanism is a snap-fit mechanism.

30. The engine assembly of claim 29, wherein the snap-fit mechanism is a resilient tab.

31. A method of installing a fuel rail assembly onto an internal combustion engine, the engine having a first part of a connector assembly, the method comprising:

providing a fuel rail assembly including a body having therein a fuel passageway, and a fuel injector coupled to the body and in fluid communication with the fuel passageway, wherein at least a portion of the body defines a second part of the connector assembly having at least a portion of a locking mechanism;

aligning the second part of the connector assembly with the first part of the connector assembly;

interconnecting and locking the second part of the connector assembly with the first part of the connector assembly to secure the fuel rail assembly to the engine without conventional threaded fasteners.

32. The method of claim 31, wherein the engine includes an engine opening to receive the fuel injector, and wherein the method further includes aligning the fuel injector with the engine opening.

33. The method of claim 31, wherein interconnecting and locking the second part of the connector assembly with the first part of the connector assembly includes inserting the second part of the connector assembly into the first part of the connector assembly.

34. The method of claim 33, wherein the engine includes an engine opening to receive the fuel injector, and wherein the fuel injector is inserted into the engine opening as the second part of the connector assembly is inserted into the first part of the connector assembly.

35. The fuel rail assembly of claim 1, wherein the at least part of the locking mechanism includes at least one of a resilient tab and an aperture.

36. The engine assembly of claim 17, wherein the locking mechanism includes at least part of a locking mechanism formed between portions of both the first and second parts of the connector assembly.

37. The engine assembly of claim 8, wherein the at least part of the locking mechanism includes at least one of a resilient tab and an aperture.

38. An engine assembly comprising:

a fuel rail assembly including a body having therein a fuel passageway, and a fuel injector coupled to the body and in fluid communication with the fuel passageway; and an engine including an engine opening to receive the fuel injector therein, wherein at least a portion of the body is interconnected with the engine such that the body is secured to the engine without using conventional threaded fasteners;

wherein the body is secured to the engine by a connector assembly, wherein the body includes a first part of the connector assembly and the engine includes a second part of the connector assembly, and wherein the first and second parts of the connector assembly are interengaged to secure the body to the engine; and wherein the one of the first and second parts of the connector assembly is a post, and wherein the other of the first and second parts of the connector assembly includes a connector opening to receive the post therein.

39. A method of installing a fuel rail assembly onto an internal combustion engine, the fuel rail assembly including a body having therein a fuel passageway, and a fuel injector coupled to the body and in fluid communication with the fuel passageway, the internal combustion engine including an injector receiving opening for receiving the fuel injector, the method comprising:

aligning the fuel injector with the injector receiving opening;

inserting the fuel injector into the injector receiving opening; and upon insertion of the fuel injector into the injector receiving opening, a portion of the body thereby automatically locking the fuel rail assembly to the engine without the use of any additional fasteners.

40. The method of claim 39, wherein the automatic locking of the fuel rail assembly to the engine occurs substantially simultaneously with completion of inserting the fuel injector into the injector receiving opening.

41. The method of claim 39, wherein the automatic locking of the fuel rail assembly to the engine includes a snap-lock engagement.

42. The method of claim 39, wherein the automatic locking of the fuel rail assembly to the engine requires no manipulation of the fuel rail assembly, the engine, or any conventional fasteners in addition to inserting the fuel injector into the injector receiving opening.

43. The method of claim 39, wherein automatically locking the fuel rail assembly to the engine includes providing at least one of the fuel rail assembly and the engine with at least a portion of a locking mechanism that operates automatically to lock the fuel rail assembly to the engine when the fuel injector is inserted into the injector receiving opening.

* * * * *